US005520023A

United States Patent [19]

Kemper

[11] Patent Number: 5,520,023

[45] Date of Patent: May 28, 1996

[54] WARP KNITTING MACHINE WITH GEARING MECHANISM

[75] Inventor: Rainer Kemper, Obertshausen, Germany

[73] Assignee: Karl Mayer Textilmaschinenfabrik GmbH, Obertshausen, Germany

[21] Appl. No.: 369,371

[22] Filed: Jan. 6, 1995

[30] Foreign Application Priority Data

Jan. 28, 1994 [DE] Germany ..... 44 02 146.1

[51] Int. Cl.[6] ..... D04B 23/00; D04B 27/00

[52] U.S. Cl. ..... 66/204

[58] Field of Search ..... 66/202, 203, 207

[56] References Cited

U.S. PATENT DOCUMENTS

| | | | |
|---|---|---|---|
| 2,562,034 | 7/1951 | Hannay | 66/204 |
| 2,978,887 | 4/1961 | Porter | 66/204 |
| 3,802,226 | 4/1974 | Kohl | 66/204 |
| 4,615,189 | 10/1976 | Durville | 66/204 |
| 4,838,047 | 6/1989 | Zorini | 66/207 |

FOREIGN PATENT DOCUMENTS

| | | | |
|---|---|---|---|
| 15935 | 12/1958 | Germany . | |
| 1241934 | 6/1967 | Germany | 66/204 |
| 2422964 | 11/1975 | Germany . | |
| 2457950 | 6/1976 | Germany | 66/203 |
| 2460862 | 6/1976 | Germany | 66/204 |
| 2507028 | 8/1976 | Germany . | |
| 1715902 | 2/1992 | U.S.S.R. | 66/204 |

*Primary Examiner*—John J. Calvert

*Attorney, Agent, or Firm*—Omri M. Behr; Matthew J. McDonald

[57] ABSTRACT

A warp knitting machine has a machine base (10), a main shaft (12) and knitting tool bars (13 to 17). Placed on the machine base is at least one gear box (18), having at least one side wall (24, 41), which is pierced by a bearing (25). A gear mechanism (27; 43) interacts on an inner portion of a shaft segment (24; 41). The outer portion of this shaft segment is drivably connected with a carrier arm (19; 37) for tool bars (13, 14, 15). In this manner, one obtains a very compact construction which inhibits oil leakage and substantially reduces noise emission while also offering the possibility of reducing the force necessary to operate the bars.

20 Claims, 4 Drawing Sheets

WARP KNITTING MACHINE WITH GEARING MECHANISM

BACKGROUND OF THE INVENTION

1. Field of the Invention

The invention is directed to a warp knitting machine with a machine base, at least one main shaft, and warp knitting tool bars, which are carried on a plurality of carrier arms, and which are reciprocatable by the main shaft over a gearing mechanism.

2. Description of Related Art

A conventional construction of such a warp knitting machine is discussed, for example, in the book by Wheatley "Raschel Lace Production," 1972, pages 29, 30, 33 and 209, which show a machine base upon which intermediate walls are attached. In these walls, carrier shafts are supported over the entire breadth of the warp knitting machine, each of which carry one or more warp knitting tool bars (n) (such as needle bars, slider bars, guide bars, sinker bars). Carrier arms for these bars are affixed on these shafts. Each carrier shaft is moved to and fro by means of plurality of push rods which protrude from the machine base and which provide the desired to and fro movement of the appropriate warp knitting tool bar.

Since the drive movement of an eccentric cam on the main shaft cannot be directly used, a gearing mechanism, suitably a coupling gear, is provided in the machine base. The carrier arms are either directly affixed to the carrier shafts or, taken together with a steering lever which is attached to the carrier shaft and a similarly stationary control lever, form a quadrilateral linkage, which provides a movement similar to alignment.

Openings must be provided in the machine base for the protrusion therethrough of push rods. In order to prevent the outflow of oil, these must be closed off with bellows. The noise which is generated by the drive is hardly reduced by these means. Furthermore, the required gearing mechanism between the main shaft and the carrier shaft, including the long push rods, is a substantially large mass, whose acceleration and deceleration during the working movement of the bars, requires the provision of a substantial Mount of energy.

Further disadvantageous is the substantially large space requirement. The reason for this is that the continuous carrier shafts with their associated carrier arms must be displaced with respect to each other in such a manner that they do not mutually interfere during operation of the process.

Accordingly, there is a need in a warp knitting machine of the described type, wherein the emission of noise is reduced and where possible, the consumption of energy is also reduced.

SUMMARY OF THE INVENTION

In accordance with the illustrative embodiments demonstrating features and advantages of the present invention, there is provided a warp knitting machine having a machine base, at least one main shaft, and a plurality of carrier arms. Each of these carrier arms have a separate knitting tool bar and each is adapted to be reciprocatably driven by the main shaft. The machine also has at least one gear box having a side wall. The gear box is attached to the machine base, and has: (a) a bearing mounted to protrude through the side wall, (b) a shaft segment journalled in the bearing and having an inner and an outer portion, and (c) a gearing mechanism. The outer portion of the shaft segment is drivably connected with one of the carrier arms. The gearing mechanism is mounted in the gear box and is coupled to the inner portion of the shaft segment.

By employing apparatus of the foregoing type, and improved gear box is achieved that can be placed at the machine base. The gear box has a side wall that supports at least one bearing through which a shaft segment protrudes. The preferred gearing mechanism interacts with the inner portion of the shaft segment, whose outer portion is drivably connected with a carrier arm.

Since it is quite simple to properly seal a bearing for the shaft segment, not only is oil emission securely prevented, but noise emission is substantially reduced. The gear box in comparison to the machine base, is a comparatively small resonance body, so that the sound radiation through its walls is substantially reduced.

The use of long push rods is no longer necessary. The gearing mechanism may be at least partially, but preferably substantially completely, transferred from within the machine base into the gear box. Thus the distance between the main shaft and the output shaft portions of the gear box is reduced. Thus, the mass to be accelerated and decelerated and thus the corresponding additional force is reduced.

The side walls of the gear box provide a good opportunity for supporting the gear segments. The construction, in accordance with the present invention, is particularly suitable for a rapidly running warp knitting machine.

It is advantageous for the gearing mechanism to be a coupling gear and the side wall to act as support for a stationary pivot for the coupling gear. In such a gear box, a substantial number of components which were heretofore necessary in a machine base, are no longer required.

In a preferred embodiment of the invention, there are provided a plurality of gear boxes of one type distributed across the breadth of the machine base, as well as the interposition of carrier arms, one of which carries the bars. By this means a continuous carrier shaft is no longer needed for each bar.

In a first embodiment, the carrier arm is attached to the shaft segment, specifically to the outer portion of the shaft segment. The bar held by the carrier arm thus executes a circular movement. This direct drive leads to a mass-reduced construction.

In a second embodiment, a quadrilateral linkage is formed by the carrier arm acting together with a control lever attached to the shaft segment and a control lever rotatably supported at a fixed point. The bar attached to such a carrier arm executes a particular movement specified by the quadrilateral linkage, in particular, an alignment. Thus, a stable construction may be obtained using comparatively light levers so that also here, a smaller mass is to be moved.

In a further embodiment., the control lever can be fixedly borne in the side wall.

It is also advantageous to provide bearings for the shaft segments through both side walls of the gear box and that each of the outer portions thereof drivably are connected with a support arm. By utilizing a gear box therefore, two carrier arms may be held and driven, which leads to a simplification of the total construction.

It is furthermore advantageous that both carrier arms are provided with lateral protrusions on mutually opposing sides. By the use of these protrusions, the support portions of the carrier arms are provided with a greater distance from each other. By this means, one can operate with a smaller number of carrier arms.

In many cases, the shaft segments in a gear box to which two different bars are provided, can have a coupling gear driveable from a common lifting means. This applies, for example, to shaft segments which activate both the guide bars and the needle bar.

Furthermore, it is advantageous if the gear box has an indentation on the forward side thereof to accommodate clearance for the knitting tools. By means of this accommodation, the gear boxes can be moved even closer to the working zone, which again leads to the possibility of size reduction.

BRIEF DESCRIPTION OF THE DRAWINGS

The present invention may be illustrated by the drawings showing the preferred embodiments, wherein.

DETAILED DESCRIPTION OF THE PREFERRED EMBODIMENTS

Figure 1:
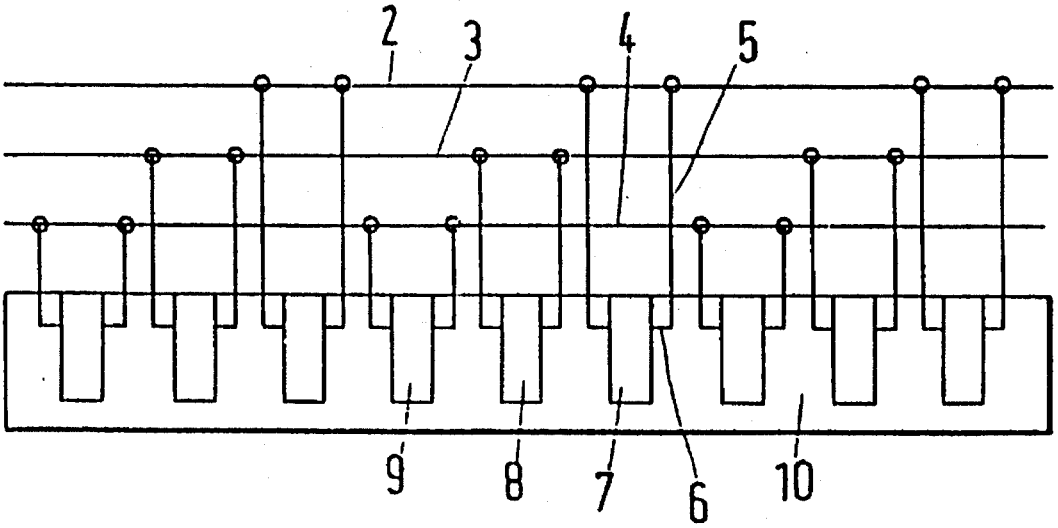
FIG. 1 is a schematic, plan view of a warp knitting machine according to the principles of the present invention.

Referring to FIG. 1, the schematically illustrated warp knitting machine possesses a plurality of knitting tool bars 2, 3 and 4, which are carried by carrier arms 5. These carrier arms 5 are connected to shaft segments 6, which are supported by the side walls of gear boxes 7 and are rotatable to and fro through a predetermined angle.

Furthermore, a plurality of gear boxes 7 of a first type are coupled to the bar 2 and further gear boxes 8 of a second type are coupled to bar 3; and finally a plurality of gear boxes 9 of the third type are coupled to bar 4.

It is advantageous, to alternate over the breadth of the machine base 10, gear boxes of one type with gear boxes of another type that carry a different bar. Thus, it is possible to lay out each entity over the breadth available to it, independently of the neighboring entities. This means in particular that the positioning of the shaft segments can be chosen solely with respect to their suitability for a bar drive without being concerned about the other carrier shafts. In general, the result thereof is also shorter transfer paths between main shaft and shaft segments, so that the power requirement is reduced because the mass to be moved is reduced.

Figure 2:
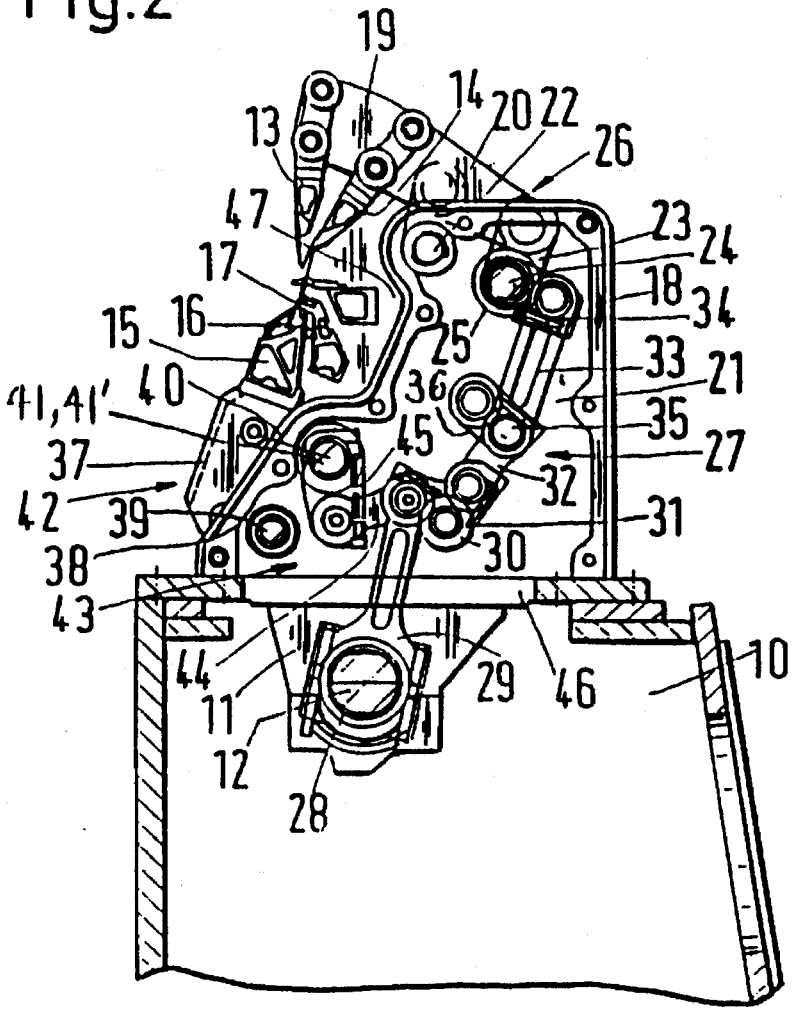
FIG. 2 is a vertical cross-sectional view through a gear box of the first type, mounted on a machine bed.

Referring to FIG. 2, one of this plurality of gear boxes is shown mounted in machine base 10 which, as is conventional, includes main shaft 12 journalled in bearings 11 rigidly held in the machine. It is advantageous for main shaft 12 to be located close to the upper side of machine base 10 and to be connected with the remaining gears, discussed presently, via a lifting means 29. Consequently, one may operate with a short lifting means, which further reduces the mass to be moved.

Figure 5:
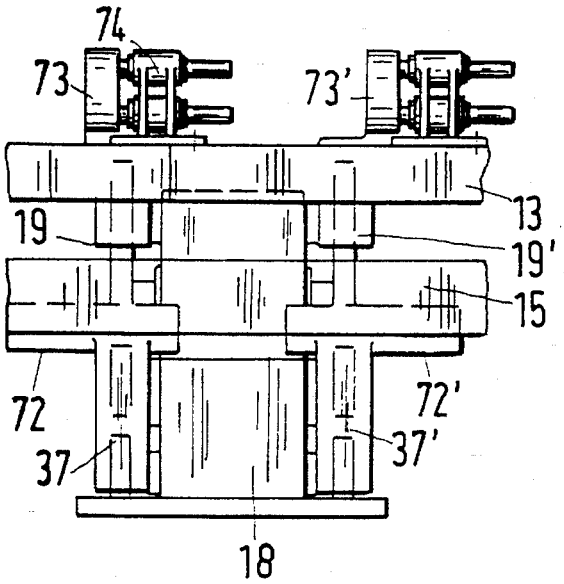
FIG. 5 is a schematic front view of a machine area with a gear box of the first type from FIG. 2.
Figure 6:
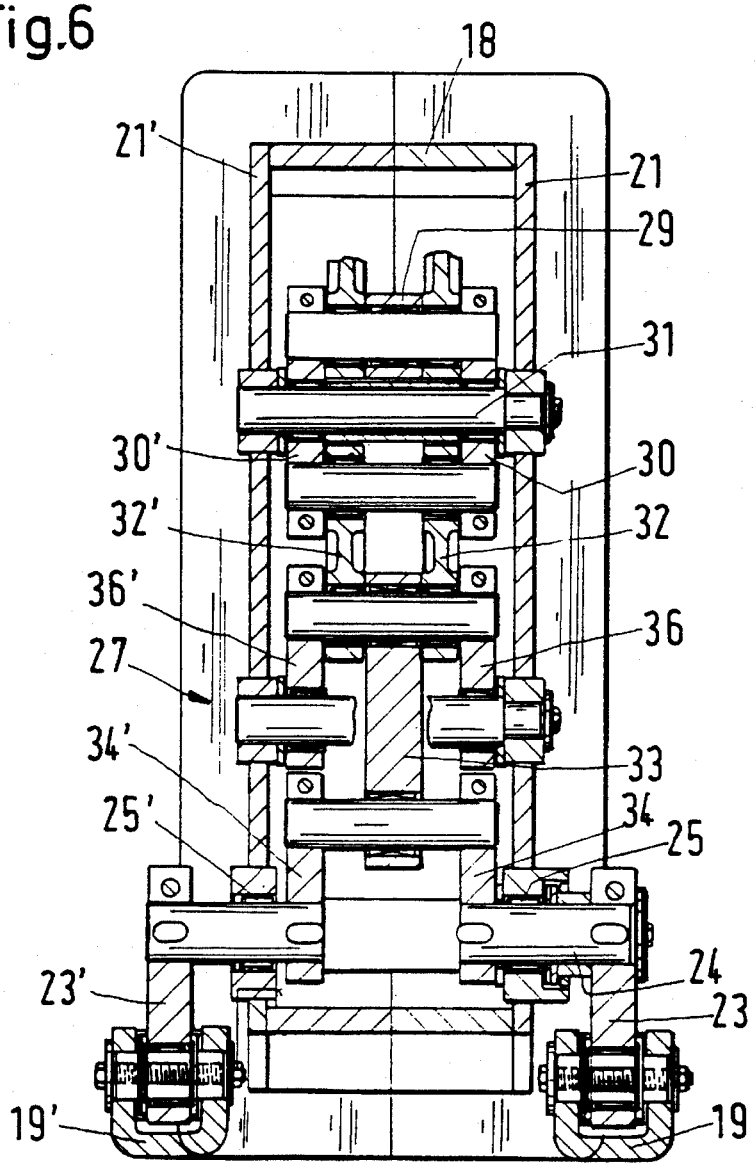
FIG. 6 is a schematic, longitudinal cross-sectional view of the gear box of the first type from FIG. 2.

The more detailed representation of the warp knitting machine shows in FIGS. 2, 5 and 6, two guide bars 13 and 14, a needle bar 15, a slider bar 16, and a sinker bar 17, whose knitting tools work together within the knitting work area.

As is shown in FIG. 2, gear box 18 operates with guide bars 13 and 14 and needle bar 15. The guide bars 13 and 14 are held by a carrier arm 19, which extends rearwardly from the guide bars to be pivotally mounted on two levers: control lever 20 and steering lever 23. Control lever 20 is in turn, rotatably mounted on the outside of the side wall 21 of gear box 18 through pivot pin 22. Steering lever 23 is attached to the outer portion of a shaft segment 24, which is rotatably mounted in bearing 25 in side wall 21.

On the inner portion of shaft segment 24, a connection is made with gearing mechanism 27, in the form of a coupling gear Gearing mechanism operates to move guide bars 13 and 14 forwards and backwards during each work cycle. Gearing mechanism.27 comprises an eccentric plate 28 which reciprocates lifting means 29 up and down. Lifting means 29 connects, via a bell crank 30 having a stationary bearing pin 31, through levers 32, 33, 34, to the inner portion of shaft segment 24. As explained further hereinafter, levers 32 and 33 are connected by pivot pin 35 which is mounted in the swinging end control lever 36, whose other end is rotatably mounted at a fixed position on side wall 21.

As will be readily recognized, the up and down reciprocation of lifting means 29 leads to a back and forth movement of carrier arm 19. Specifically, the rocking of crank 30 rocks lever 36, which, operating through lever 33, rocks lever 34 and shaft segment 24.

Needle bar 15 is attached to support arm 37 which is pivotally attached to the swinging ends of control lever 38 and steering lever 40. Control lever 38 is rotatably attached on the outside of side wall 21 through link pin 39. Steering lever 40 is attached to the outer portion of shaft segment 41, which is rotatably mounted in bearing 41 in side wall 21 of gear box 18. Here also, there is provided a quadrilateral linkage 42, which gives rise to a substantially linear motion for needle bar 14. The drive comes from a gearing mechanism 43, which employs a drive lever 45 affixed to shaft segment 41. Lever 45 is reciprocated by lever 44, which is pivotally mounted between lever 45 and lifting means 29.

Gear box 18 covers an Opening 46 in the top of machine base 10. The sole openings in side wall 21, which may be readily sealed off, are formed by bearing 25 for shaft segment 24 and the bearing for shaft segment 41. Thus, there need be no fear of either oil leakage or noise emission. Gear box 18 has an indentation 47, which enables pivot pins 22 to be located very close behind guide bars 13 and 14 without interfering with the work area in any other way.

Main shaft 12 is located a short distance under the top of machine base 10, so that the gearing mechanism 27 or 43 need only extend over a small distance and therefore the mass of the gear parts can be held quite small. Thus, only small forces are needed to operate the knitting tools, which is of great interest in high speed machines.

Advantageously, the gear box 18 ends at the level of guide bars 13 and 14 and even above the carrier arm 19. Thus, no further holding means are required, which yields a very compact construction wherein the thread provision means can be provided exceedingly close above the guide bars.

Preferably, the gear boxes 18 are located behind the guide bars 13 and 14 and extend to their height and at their upper ends carry quadrilateral linkage, whose middle portions are formed by the end segments of the carrier arms 19, which are substantially perpendicular to the travel path of the needles in bar 15. The guide bars 13 and 14 are therefore controlled not from above, but rather from their rear side. This leads, on the one hand, to a shorter transfer path between the main shaft 12 and the shaft segment 24, and on the other hand, it leaves the area above the guide bars 13 and 14 free so that there is much greater freedom for the location of the warp beams and the guiding of the thread input. In particular in Raschel machines, this positioning has the advantage permitting elimination of not only the suspension bearings, but also traverse pipes.

Figure 3:
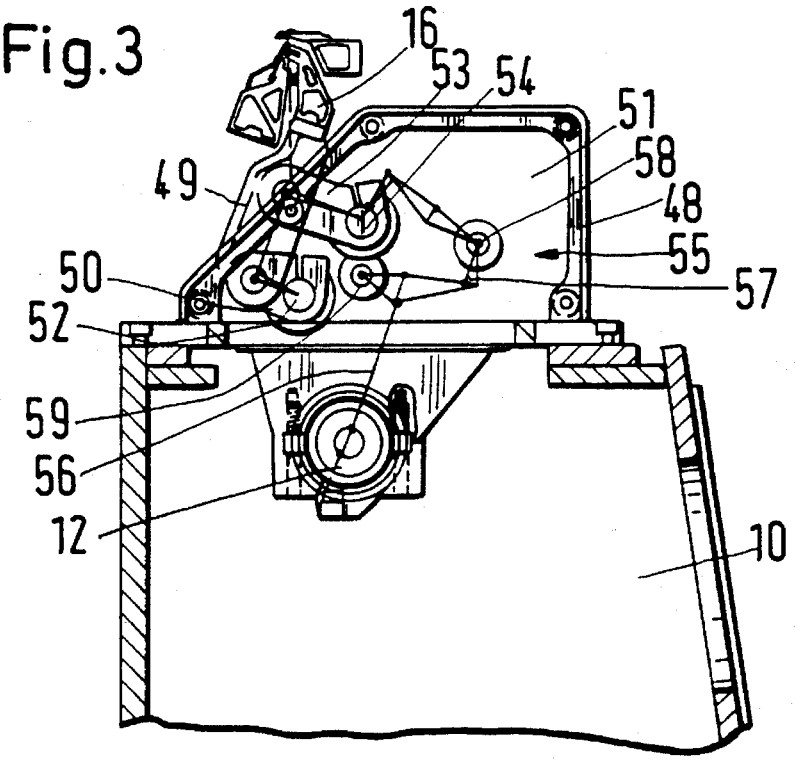
FIG. 3 is view similar to that of FIG. 2 through another gear box of the second type, which replaces some detail with schematic representations.

FIG. 3 shows an alternate gear box 48 of a second type, which is utilized to operate slider bar 16. Bar 16 is attached to a carrier arm 49, which is pivotally attached at spaced positions to control lever 50 and steering lever 53. Control lever 50 is rotatably mounted through pivot pin 52 to side wall 51 of gear box 48. Steering lever 53 is mounted on the outer portion of shaft segment 54, which is rotatably mounted in a bearing in side wall 51. The inner portion of this shaft segment interacts with gearing mechanism 55, which comprises: (a) a lifting means 56 activated by an eccentric cam on main shaft 12 and (b) a coupling gear 57 operating with a bell crank at fixed pivot point 58 and a control lever at fixed pivot point 59. As is shown schematically, the up and down reciprocation of lifting means 56 leads to an up and down reciprocation of slider bar 16.

Figure 3A:
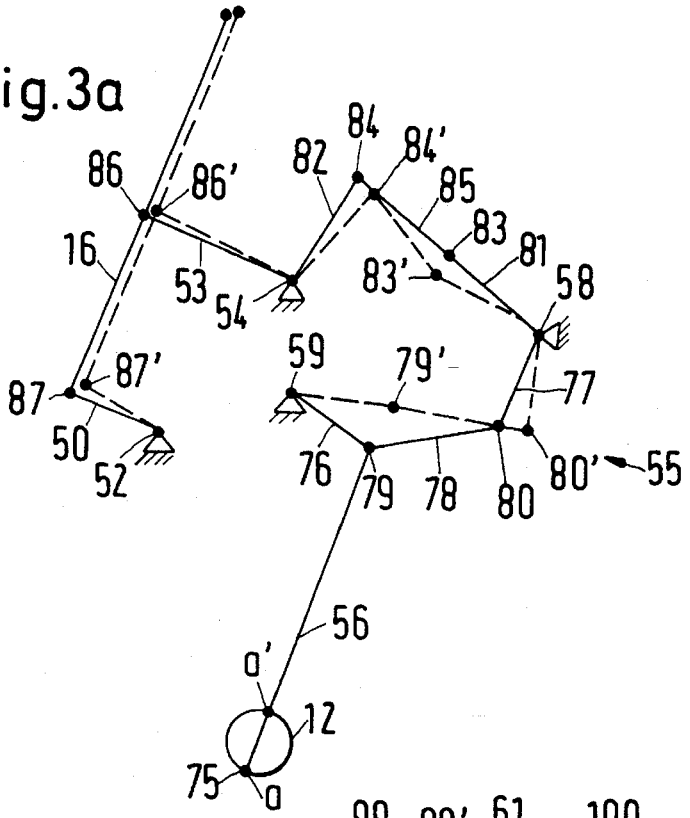
FIG. 3*a* is a schematic diagram representing the motion of elements of FIG. 3.

FIG. 3*a* shows the gear mechanism 55 in an expanded representation, wherein individual levers are shown schematically as lines that can move to the positions illustrated as dotted lines. Push rod 56 is attached to an eccentric cam on main shaft 12 by means of a pivot at point 75. The gear mechanism 55 comprises (a) a lever 76, which is rotatably supported at fixed pivot point 59 and connected to pivot point 79 of push rod 56 and (b) a lever 77, which is rotatably supported at fixed pivot point 58. A further lever 78 is connected between free pivot point 79 of push rod 56 and pivot point 80 of lever 77.

Gear mechanism 55 further comprises a lever 81 which is angularly fixed with respect to lever 77 to rotate together about at stationary pivot point 58 so that these in combination give rise to an angle lever. Lever 82 is angularly fixed with respect to steering lever 53 to rotate together about stationary pivot point 54, so that an angle lever is provided. The end points of levers 81 and 82 are respectively connected via free pivot points 83 and 84 with lever 85. Connected at the end of steering lever 53 is slider bar 16 at moveable pivot point 86. The lower end of bar 16 is connected to swingable control lever 50 via pivot point 87. The other end of lever 50 is connected to fixed pivot point 52.

When the push rod 56 assumes position a, all parts of the drive 55 are located in the position drawn in full lines. On the other hand, when the push rod 56 moves into position a', then all of the parts of gear mechanism 55 move into the positions designated in phantom. Thus, pivot point 79 moves to 79', pivot point 80 to 80', pivot point 83 to 83', pivot point 84 to 84', pivot point 86 and 87 to 86' and 87'. This leads to the desired up and down movement of slider bar 16.

Figure 4:
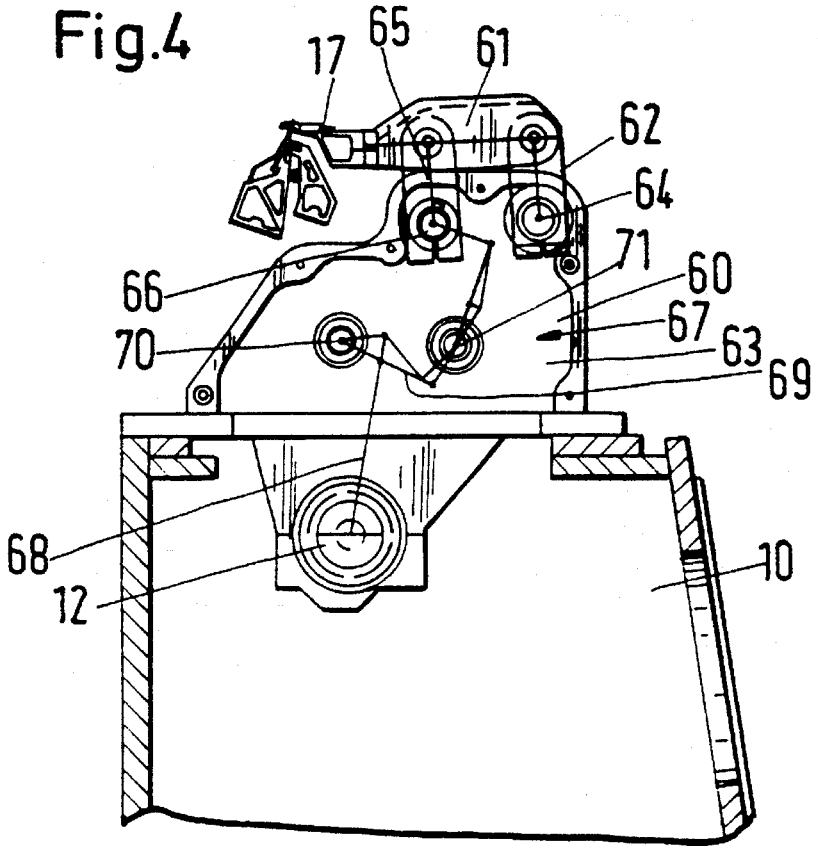
FIG. 4 is view similar to that of FIG. 2 through yet another gear box of the third type, which replaces some detail with schematic representations.

FIG. 4 illustrates a gear box 60 of a third type, which is provided to sinker bar 17. Bar 17 sits on carrier arm 61 which is pivotally connected upon lever 62 and steering lever 65.. Lever 62 is connected to bearing pin 64 protruding from the outside of side wall 63. Steering lever 65 is connected to the outer portion of shaft segment 66 carried in a bearing in side wall 63. The inner portion of this shaft segment 66 is connected with a gearing mechanism 67, which comprises a lifting means 68 and a coupling-gear 69 with two stationary pivots 70 and 71. Lifting means 68 is activated by an eccentric cam on the main shaft 12. In this manner, the up and down movement of the lifting means 68 is translated in to a to and fro movement of sinker bar 17.

Figure 4A:
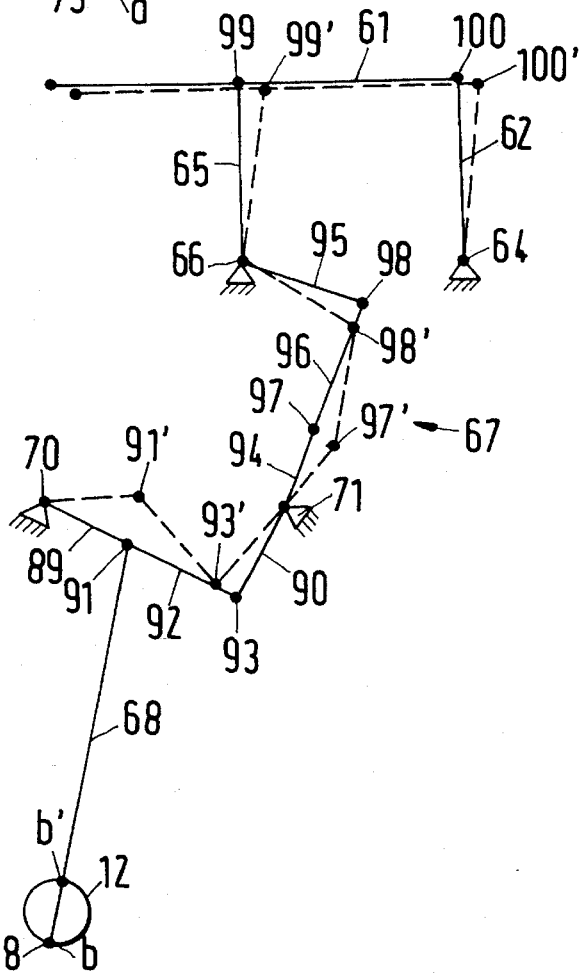
FIG. 4*a* is a schematic diagram representing the motion of elements of FIG. 4.

Again in FIG. 4a, the individual levers are schematically represented as lines. The push rod 68 is pivotally connected at point 88 with an eccentric cam on main shaft 12. Gear mechanism 67 comprises (a) a lever 89, which is swingable about the stationary pivot point 70, and (b) a lever 90 which is swingable about stationary pivot point 71. A free pivot point 91 connects the push rod 68, the lever 89 and one end of lever 92. The other end of lever 92 is connected via free pivot point 93 with lever 90.

The gear mechanism 67 further comprises (a) a lever 94, which is rotatable about a stationary pivot point 71 and is angularly fixed with respect to lever 90 to rotate together therewith and form an angle lever, and (b) lever 95 which is swingable about a stationary pivot point 66. A further lever 96 is connected via free pivot point 97 with lever 94 and via a free pivot point 98 with lever 95. Lever 95 is angularly fixed with respect to steering lever 65, which is connected via pivot point 99 to carrier arm 61. A second pivot point 100 arises between guide lever 62 and the carrier arm 61.

When push rod 68 is shown in position b all the parts of drive 67 are shown in the positions indicated by the solid lines. When push rod 68 moves to point b', all the parts of the drive then move into the positions indicated in phantom; that is to say, the pivot point 91 moves to 91', the pivot point 93 moves to 93' the pivot point 97 to 97', the pivot point 98 to 98' and the pivot point 99 and 100 to 99' and 100', respectively. Thus, the sinker bar moves backwards and forwards.

FIG. 5 illustrates in a simplified fashion the gear box 18, that is, viewed from the left hand side of FIG. 2. A pair of carrier axis 37 and 37' for needle bar 15 are provided on both sides of gear box 18. The oppositely extending protrusions 72 and 72' on carrier arms 37, 37' provide a large surface support for the needle bar 15. In similar manner on both sides of gear box 18, there are provided two carrier arms 19 and 19' with appropriate protrusions 73 and 73', upon which the individual guide bars 13 are held via the longitudinal guide means 74, for example, in the form of rods held in roller bearings.

FIG. 6 shows an arbitrarily located cross-section through gear box 18, wherein all of parts are arranged symmetrically so that the forces and turning moments can be equally distributed over the carrier arms 19 and 19'. In particular, there are provided two control levers 23 and 23' to mutually connected shaft segments 24 and 24', and the appropriate bearings 25 and 25' in side walls 21 and 21'. Even the individual levers of the gearing mechanism 27 are arranged symmetrically in pairs.

I claim:

1. A warp knitting machine comprising:

a machine base;

at least one main shaft;

a plurality of carrier arms each having a separate knitting tool bar and each being adapted to be reciprocatably driven by the main shaft; and at least one gear box having a side wall, and being attached to said machine base, said gear box comprising:

(a) a bearing mounted to protrude through said side wall, (b) a shaft segment rotatably journalled in said bearing and having a driven inner portion and an outer portion, said outer portion extending outside said gear box and being connected to drive one of said carrier arms, and (c) a gearing mechanism mounted in said gear box and coupled between said main shaft and the inner portion of the shaft segment for rotatably driving said shaft segment.

2. A warp knitting machine in accordance with claim 1, wherein said gear box is substantially mounted entirely above the machine base.

3. A warp knitting machine in accordance with claim 2, wherein the main shaft is located close to the upper side of the machine base, said warp knitting machine comprising:

a lifting means for coupling the main shaft to the gearing mechanism.

4. A warp knitting machine in accordance with claim 1, wherein the gearing mechanism comprises:

a coupling gear having a fixed pivot supported by the side wall.

5. A warp knitting machine in accordance with claim 1, wherein said at least one of the gear boxes comprises:

a first plurality of typical gear boxes spatially distributed across the breadth of the machine base and supporting through a first group of said carrier arms a common one of the tool bars.

6. A warp knitting machine according to claim 5, wherein said at least one gear box comprises:

a second plurality of spaced gear boxes alternating with, and being of a different type than, said first plurality of typical gear boxes, said second plurality of gear boxes supporting through a second group of said carrier arms a corresponding one of the tool bars.

7. A warp knitting machine in accordance with claim 5, wherein the first group of carrier arms is attached to the shaft segments of the first plurality of typical gear boxes.

8. A warp knitting machine in accordance with claim 5, wherein at least one of said carrier arms comprises:

a quadrilateral linkage having a steering lever and a guide lever mounted to rotate about a fixed location, said steering lever being connected between the shaft segment and the carrier arm.

9. A warp knitting machine in accordance with claim 1, wherein at least one of said carrier arms comprises:

a quadrilateral linkage having a steering lever and a guide lever mounted to rotate about a fixed location, said steering lever being connected between the shaft segment and the carrier arm.

10. A warp knitting machine in accordance with claim 9, wherein the guide lever is rotatably supported by the side wall to rotate about at a spatially fixed axis.

11. A warp knitting machine in accordance with claim 1, wherein the side wall of said gear box has in opposing positions a first and a second wall, said outer portion of the shaft segment having a pair of opposite portions protruding through said first and said second wall of said side wall, said pair of opposite sections of said outer portion being drivably connected with two of the carrier arms.

12. A warp knitting machine in accordance with claim 3, wherein the side wall of said gear box has in opposing positions a first and a second wall, said outer portion of shaft segment having a pair of opposite sections protruding through said first and said second wall of said side wall, said pair of opposite sections of said outer portion being drivably connected with two of the carrier arms.

13. A warp knitting machine in accordance with claim 5, wherein the side wall of said gear box has in opposing positions a first and a second wall, said outer portion of shaft segment having a pair of opposite sections protruding through said first and said second wall of said side wall, said pair of opposite sections of said outer portion being drivably connected with two of the carrier arms.

14. A warp knitting machine in accordance with claim 7, wherein the side wall of said gear box has in opposing positions a first and a second wall, said outer portion of the shaft segment having a pair of opposite sections protruding through said first and said second wall of said side wall, said pair of opposite sections of said outer portion being drivably connected with two of the carrier arms.

15. A warp knitting machine in accordance with claim 8, wherein the side wall of said gear box has in opposing positions a first and a second wall, said outer portion of shaft segment having a pair of opposite sections protruding through said first and said second wall of said side wall, said pair of opposite sections of said outer portion being drivably connected with two of the carrier arms.

16. A warp knitting machine in accordance with claim 15, wherein the two of the carrier arms comprise:

lateral protrusions extending in opposite directions.

17. A warp knitting machine in accordance with claim 5, including a plurality of needles adapted to reciprocate along a needle lift path, and a guide bar extending in front of and at about the height of said gear box, at least one of said carrier arms comprising:

a quadrilateral linkage coupled over said guide bar and having a middle section is formed by end segments of the support arms extending perpendicularly to the needle lift path.

18. A warp knitting machine in accordance with claim 1, wherein the gearing mechanism includes a pair of coupling gears having a fixed pivot supported by the side wall, the warp knitting machine comprising:

a common lifting mechanism coupled to and driven by said main shaft for operating said pair of coupling gears, said shaft segment of said gear box including a spaced pair of separate shaft sections separately coupled between (a) the tool bar of two different ones of the carrier arms, and (b) said coupling gears of said gearing mechanism.

19. A warp knitting machine in accordance with claim 8, wherein the gearing mechanism includes a pair of coupling gears having a fixed pivot supported by the side wall, the warp knitting machine comprising:

a common lifting mechanism coupled to and driven by said main shaft for operating said pair of coupling gears, said shaft segment of said gear box including a spaced pair of separate shaft sections separately coupled between (a) the tool bar of two different ones of the carrier arms, and (b) said coupling gears of said gearing mechanism.

20. A warp knitting machine in accordance with claim 1, wherein the gear box has on its forward side a rearward indentation to give clearance near the tool bars of the carrier arms.

* * * * *